US005489047A

United States Patent [19]

Winder

[11] Patent Number: 5,489,047

[45] **Date of Patent: *Feb. 6, 1996**

[54] AEROSOL SPRAY CAN ADAPTOR

[75] Inventor: Gary C. Winder, Etobicoke, Canada

[73] Assignee: CCL Industries Inc., Concord, Canada

[ * ] Notice: The term of this patent shall not extend beyond the expiration date of Pat. No. 5,383,580.

[21] Appl. No.: 350,676

[22] Filed: Dec. 7, 1994

Related U.S. Application Data

[63] Continuation of Ser. No. 45,023, Apr. 5, 1993, Pat. No. 5,383,580.

[51] Int. Cl.[6] ..... B65D 88/54

[52] U.S. Cl. ..... 222/325; 222/504; 285/390

[58] Field of Search ..... 222/183, 402.1, 222/325, 504, 645–649; 285/39, 350, 390, 423, 921

[56] References Cited

U.S. PATENT DOCUMENTS

| | | | |
|---|---|---|---|
| 1,388,622 | 8/1921 | Voorhees | 285/390 |
| 2,669,469 | 2/1954 | Finch | 285/390 |
| 3,331,534 | 7/1967 | Brown | 222/504 |
| 3,398,864 | 8/1968 | Kolodziej | 222/645 |
| 3,666,144 | 5/1972 | Winder | 222/504 |
| 3,764,044 | 10/1973 | Pajak | 222/649 |
| 4,077,542 | 3/1978 | Petterson | 222/649 |
| 5,025,962 | 6/1991 | Renfro | 222/649 |
| 5,383,580 | 1/1995 | Winder | 222/325 |

*Primary Examiner*—Andres Kashnikow
*Assistant Examiner*—Philippe Derakshani
*Attorney, Agent, or Firm*—Sim & McBurney

[57] ABSTRACT

An aerosol spray can and selectively-operable valve mechanism for dispensing the contents of the can to an environment are assembled to one another in operable relation using an adaptor structure which comprises an element snap-fit mounted to the aerosol can and a further element snap-fit mounted or otherwise affixed to the valve mechanism. The elements are provided with mating screw threads, which permit the assembly to be readily and securely effected. The adaptor elements are moulded parts constructed to be resiliently flexible to a degree to assist in mounting and demounting from the element to which it is to be attached and yet to resist such flexure when assembled together.

15 Claims, 6 Drawing Sheets

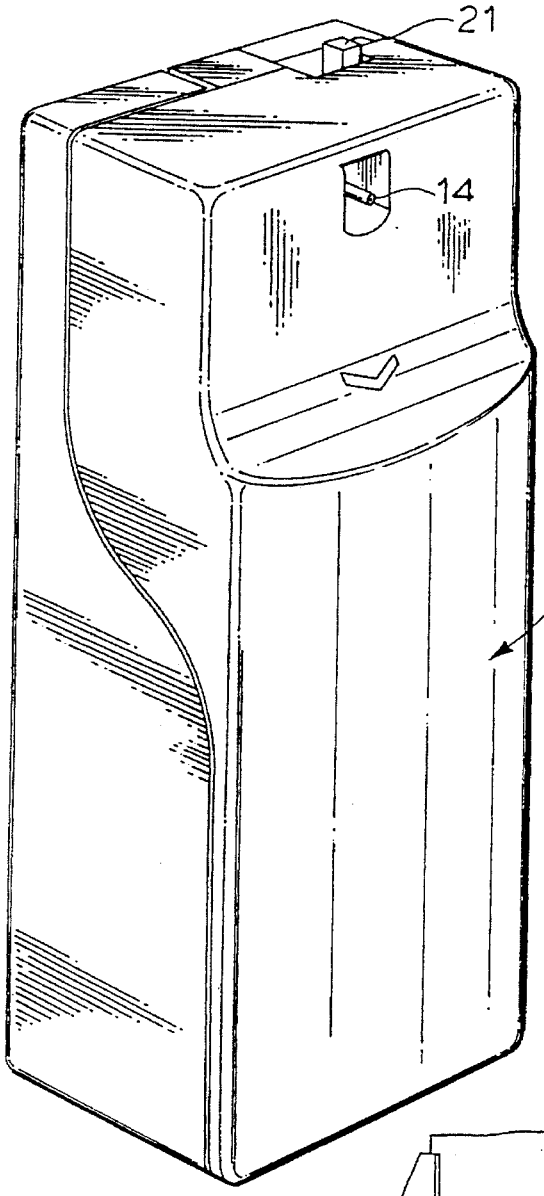
FIG. 1.
FIG. 9.
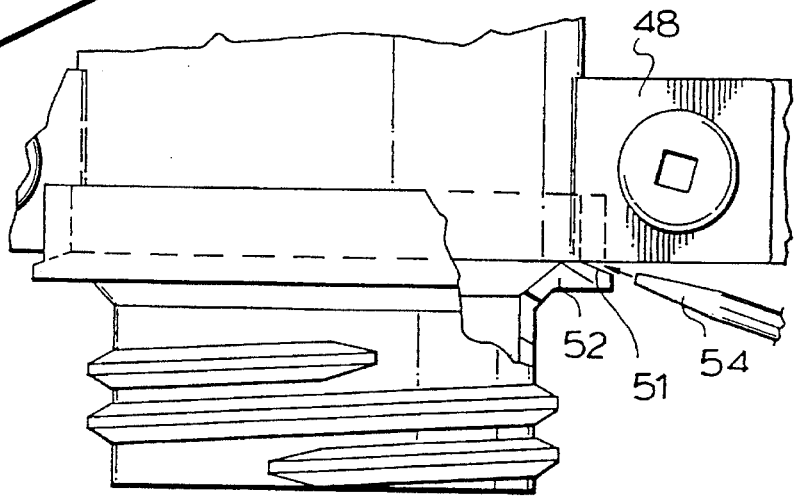

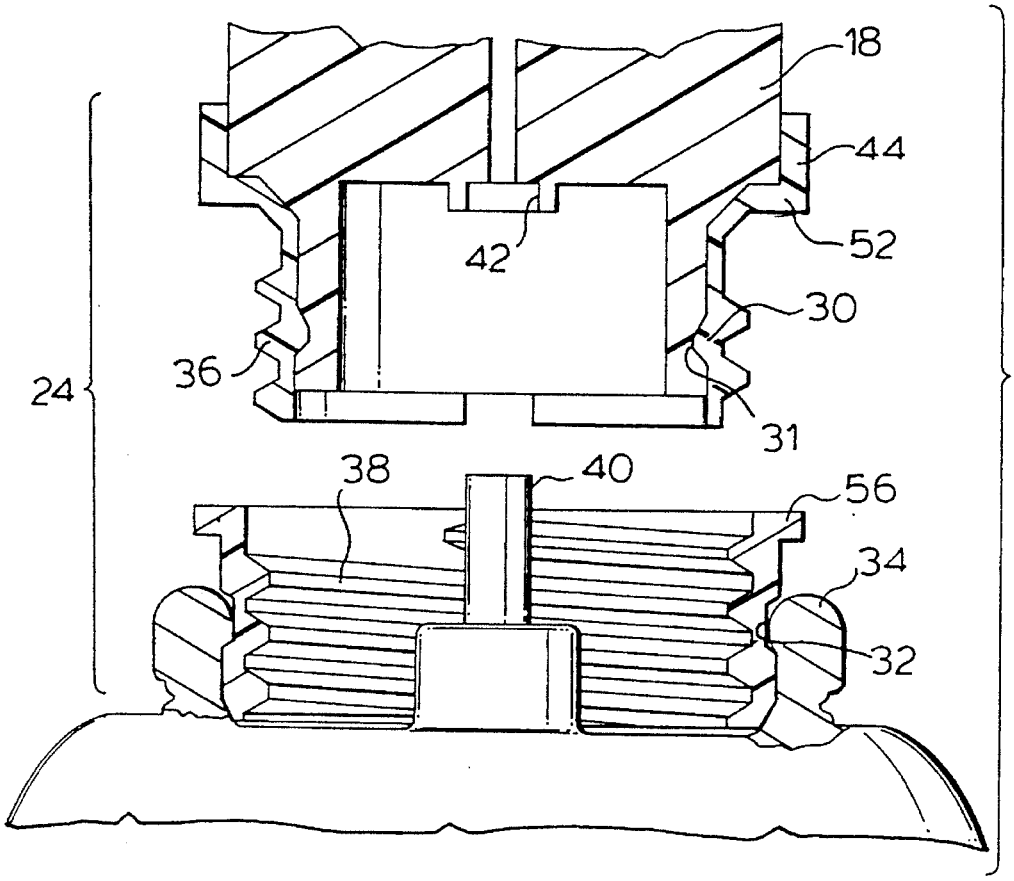
FIG. 4.
FIG. 5.
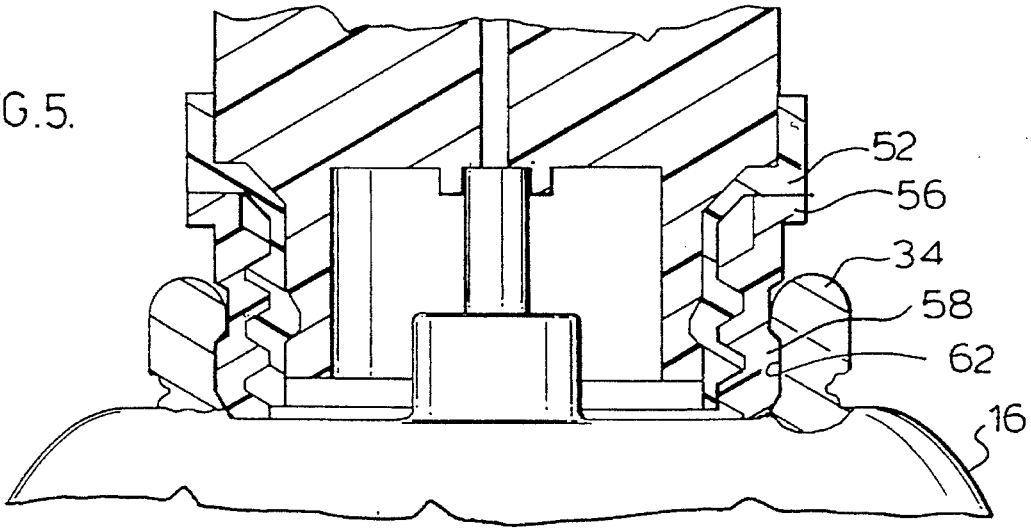

AEROSOL SPRAY CAN ADAPTOR

This is a continuation of application Ser. No. 08/045,023 filed Apr. 5, 1993 (now U.S. Pat. No. 5,383,580).

FIELD OF THE INVENTION

The present invention relates to an aerosol spray dispensing device and, in particular, an adaptor for connecting an aerosol can of material to be sprayed to a solenoid valve mechanism which selectively permits material to be dispensed from the aerosol can to an environment.

BACKGROUND TO THE INVENTION

In U.S. Pat. No. 3,666,144, assigned to the assignee hereof and the disclosure of which is incorporated herein by reference, there is described a system for selectively dispensing aerosol spray material to an environment comprising an enclosure, a solenoid-activated valve mechanism in the enclosure through which the aerosol spray material may be dispensed and an aerosol can in the enclosure mounted to the valve mechanism. The mounting between the aerosol can and the valve mechanism comprises an element which snaps into the rim of the aerosol container and also snaps onto a circular lip formed adjacent to the lower extremity of the valve mechanism.

The spent can with element attached is removed from the solenoid valve mechanism and replaced. Close tolerances were required to ensure that the element could be demounted readily from the valve mechanism for replacement of spent can and yet would provide a sufficient grip to ensure that the aerosol can does not become dislodged from the valve mechanism in use.

In addition, care was necessary to ensure that, during assembly of a new aerosol can to the valve mechanism, proper and precise alignment was maintained between the aerosol can valve stem and the upstream inlet of the solenoid valve mechanism.

SUMMARY OF INVENTION

The problems inherent in the utilization of this snap-on ring structure are overcome by the provision herein of an adaptor which comprises two elements which are screw-threaded together. One of the elements is snap-fit mounted on the rim of the aerosol can and the other is snap-fit mounted on, permanently affixed to or integrally-formed with the solenoid valve structure.

Accordingly, in one aspect of the present invention, there is provided an adaptor device for connecting an aerosol spray can with a selectively-operable valve mechanism for dispensing the contents of the aerosol can. The adaptor device comprises first and second elements each of which is provided with screw threads to mate with the other. The first element has means for mounting the same to a cylindrical upstream portion of the valve mechanism and the second element has means for mounting the same to an undercut rim of the aerosol can.

The provision of mating screw threads on the two separate elements ensures ready and secure assembly and disassembly of the aerosol can and solenoid valve mechanism without any tendency to become accidentally dislodged in use. Further, a proper alignment of aerosol can stem and upstream end of the solenoid valve structure is assured before they come together in assembled relation.

In addition, since the two elements support each other against deformation in the assembled condition, the individual elements may be constructed to be more-readily deformable than the conventional ring structure for more ready assembly and disassembly of the individual elements from their mounting with the aerosol can or solenoid valve mechanism.

The element which is intended to be assembled with the aerosol can generally is provided already mounted to a replacement aerosol can and is discarded with a spent can. For this reason, the can element is designed to resist demounting from assembly with the can.

The element which is intended to be assembled with the solenoid valve mechanism may comprise a separate element suitably mounted to the valve mechanism. Since this element functionally generally remains permanently positioned in assembled relation with the valve mechanism, such element may be arranged to be permanently affixed to the valve mechanism or may be provided as an integrally-formed part of the valve mechanism.

Assembly and disassembly of an aerosol can with the solenoid valve mechanism is effected readily but securely by screw-threaded engagement and disengagement of the respective elements.

BRIEF DESCRIPTION OF DRAWINGS

FIG. 1 is a perspective front view of an aerosol spray dispensing device employing the adaptor of the invention;

FIGS. 4 and 5 contain close-up detailed sectional views of the components of the adaptor of FIG. 3 and their assembly with the other elements of the aerosol spray dispensing device;

FIG. 9 is a detailed view showing means for disassembly of the adaptor from the spray-forming component of the device.

DESCRIPTION OF PREFERRED EMBODIMENT

Figure 2:
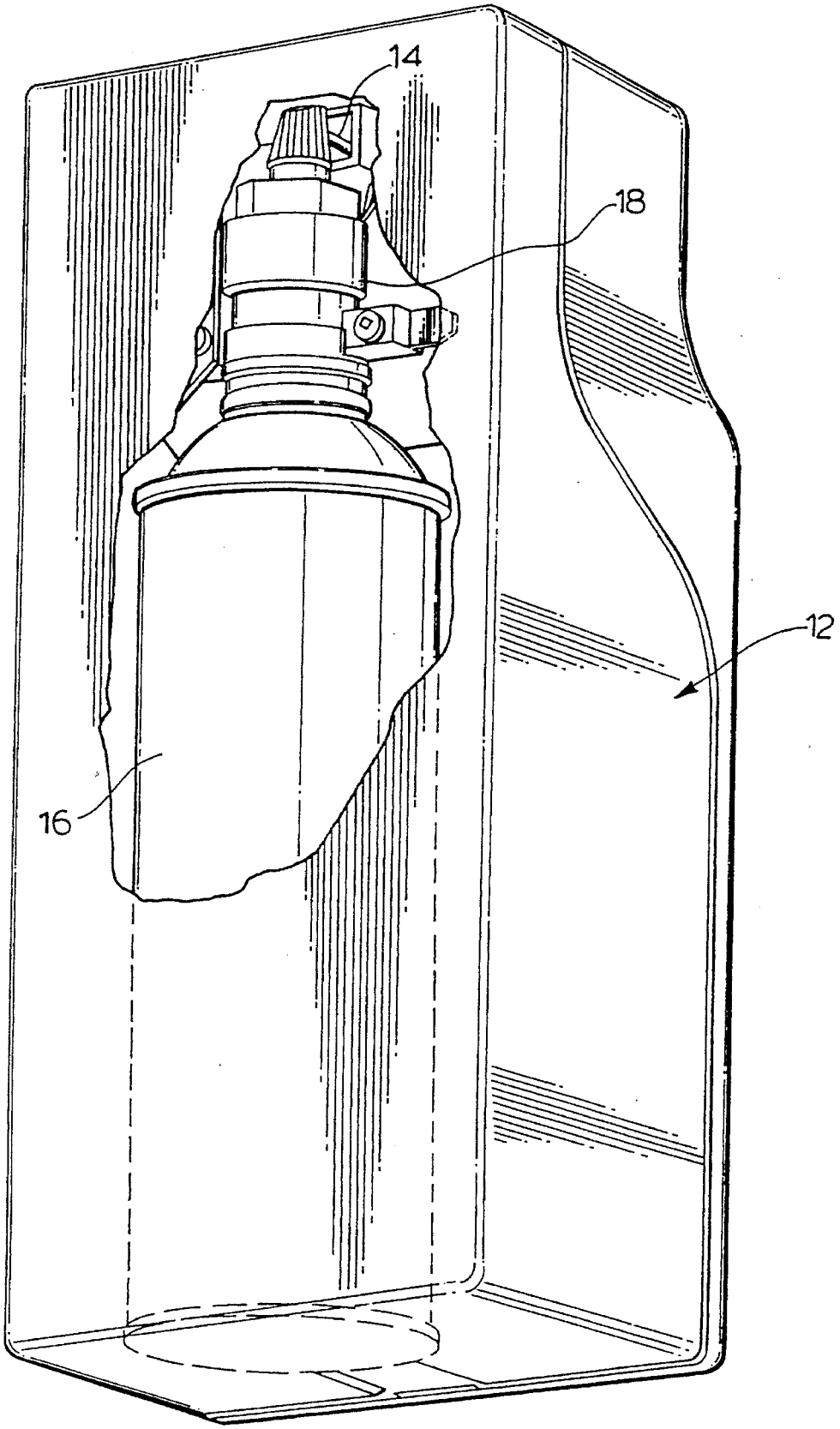
FIG. 2 is a perspective rear view of the device of FIG. 1, with parts cut away to show detail of the spray forming assembly.
Figure 3:
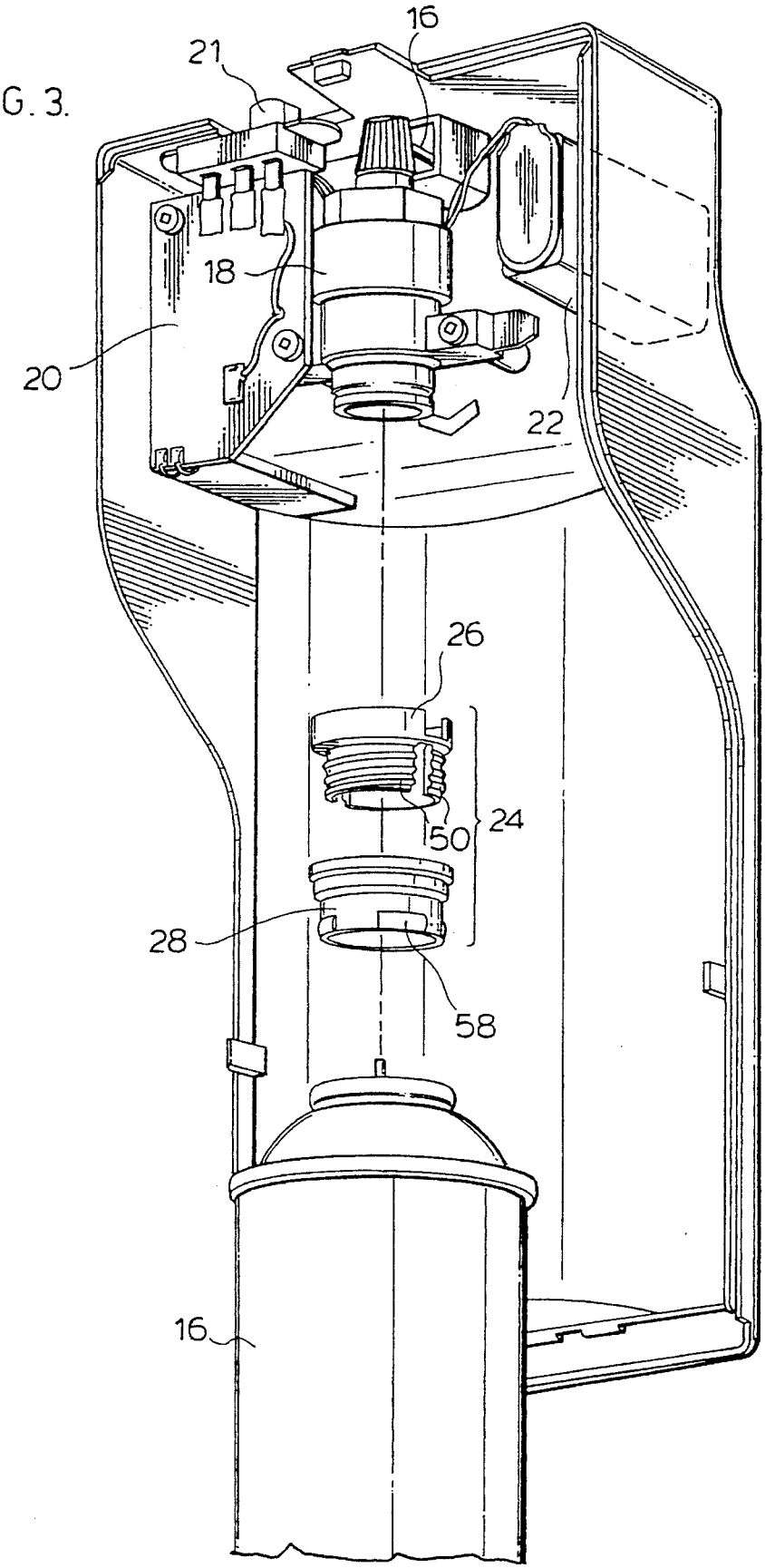
FIG. 3 is an exploded view of the assembly of FIG. 2 showing the constituent elements of the aerosol spray dispensing device, including an adaptor constructed in accordance with one embodiment of the invention.

Referring to the drawings, an aerosol spray dispensing device 10 comprises an enclosure or housing 12 having a nozzle 14 through which aerosol spray is dispensed on an intermittent basis to an ambient atmosphere. The housing 12 contains an aerosol can 16 of material to be dispensed to the environment outside the housing 12, for example, a fragrance or an insecticide. The aerosol can 16 is mounted in releasable relation to a solenoid-activated valve mechanism 18 fixedly mounted in the housing 12 and operatively connected to the nozzle 14, so that an aerosol spray of material may be dispensed from the aerosol can through the nozzle 14.

The valve mechanism 18 may have any convenient structure which permits selective opening and closing to dispense aerosol spray from the can 16 through the nozzle 14. The structure may be that described in the aforementioned U.S. Pat. No. 3,666,144, but any other convenient mechanism may be adopted. The valve mechanism 18 may be controlled by a suitable electronic control panel 20 with an on-off switch 21 and powered by an electric battery 22. The control panel 20 may control the frequency of opening of the valve mechanism 18 for dispensing aerosol material through nozzle 14 and the length of time for which the valve mechanism 18 is open for such dispensing.

The aerosol can 16 is mounted to the valve mechanism by a two-piece adaptor 24, comprising an upper element 26 snap-fit mounted to the valve mechanism 18 and a lower element 28 snap-fit mounted to the aerosol can 16, the upper and lower members 26 and 28 being screw-threaded together. While the upper element 26 is illustrated as comprising an individual mountable and demountable element, such element may be permanently affixed to or may be part of the valve mechanism 18.

Figure 6:
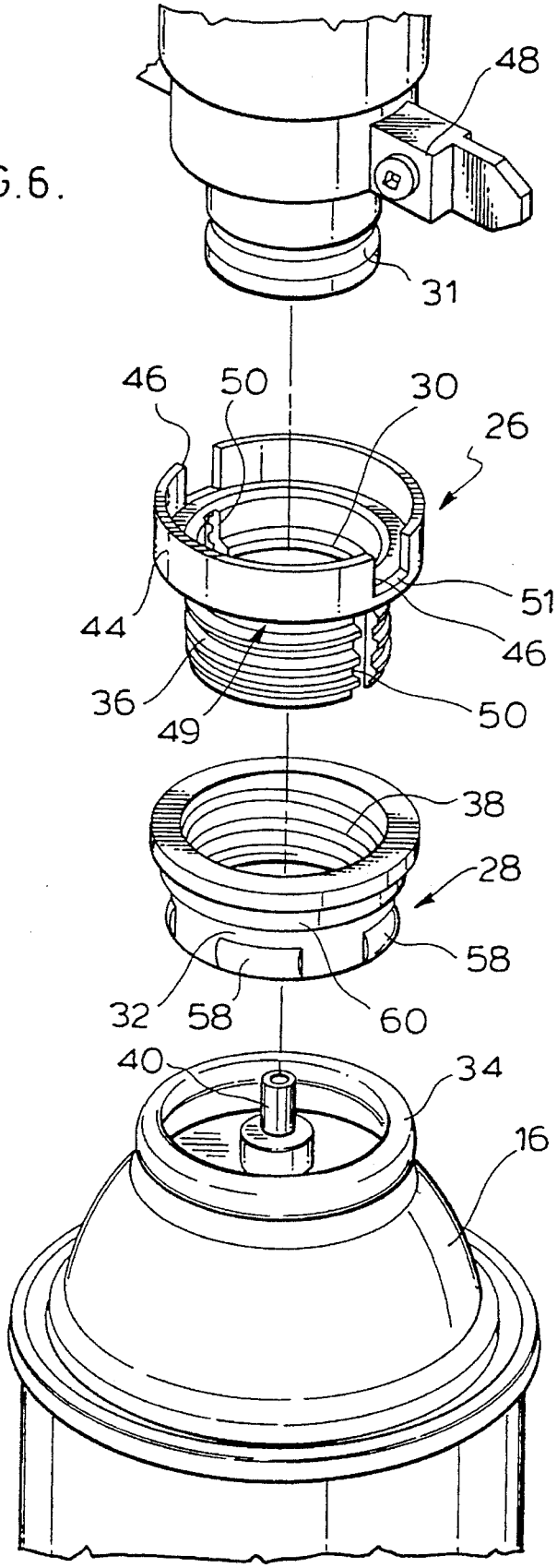
FIG. 6 is a perspective exploded view of the components of the adaptor of FIG. 3 and the other elements of the aerosol spray dispensing device.

As may be seen particularly in FIGS. 4 and 6, the upper element 26 is provided with an internal flange 30 which snap fits into a complimentary groove 31 formed in the valve mechanism 18 to mount the upper element 26 to the valve mechanism 18. The lower element 28 has an external groove 32 which snap-fits over a bulbous rim 34 of the aerosol can 16.

The upper element 26 has outer screw threads 36 while the lower element 28 has inner mating screw threads 38 which enable the elements 26 and 28 to be screw-threaded together. The aerosol can 16 is mounted to the valve mechanism 18 by screw threading the elements 26 and 28 together by rotating the aerosol can 16 relative to the valve mechanism 18. The snap-fit mountings of the elements 26 and 28 to the respective valve mechanism 18 and aerosol can 16 provides a structure which resists relative rotational movement between the respective element and the valve mechanism and aerosol can, permitting the aerosol can 16 to be readily screw threadedly mounted to the valve mechanism 18. This arrangement ensures proper alignment of the valve stem 40 of the aerosol can 16 and its seat 42 at the upstream end of the valve mechanism 18, since screw-threaded engagement occurs before the stem 40 becomes seated.

As may be seen particularly from FIG. 6, the upper element 26 comprises an upper cylindrical portion 44 which has diametrically-located upwardly-opening slots 46 formed therein to provide resistance to rotation of the upper element 26 relative to the valve mechanism 18 by reason of receipt of mounting element 48 of the valve mechanism 18 in the slots 46 while the internal flange 30 is seated in the groove 31. Alternatively, such resistance to rotational movement may be achieved by permanent mounting of the upper element 26 on or integral formation of the upper element 26 with the valve mechanism 18.

A lower screw-threaded cylindrical portion 49 of the upper element 26 includes diametrically-located downwardly-opening slots 50. Such slots 50 permit outward flexure of the lower cylindrical portion 49 of upper element 26 for ease of assembly and disassembly of the upper element 26 to and from the valve mechanism 18. When the upper portion 26 is screw threadedly assembled with the lower portion 28, however, such outward flexure is resisted by the lower portion 28, so that, when elements 26 and 28 are assembled together, the upper element 26 is not readily demounted from the valve mechanism 18. As seen particularly in FIG. 9, the upper surface 51 of the annular flange 52 joining the upper and lower cylindrical portions 44, 49 of the upper adaptor element 26 may be canted, at least in the region of the slot 46, to permit insertion of the blade of a screwdriver 54 or like implement between the surface 51 and the adjacent mounting element 48 to assist in releasing the upper element 26 from its snap-fit mounting to the valve mechanism.

As also seen particularly in FIG. 4, the lower element 28 is provided with an annular flange 56 which seats against the underside of the flange 52 of the upper element 26 when the elements are fully screw-threadedly assembled (see FIG. 5). A plurality of discontinuous protrusions 58 is provided on a lower cylindrical portion 60 of the lower element 28 to snap into an undercut or groove 62 of the bulbous rim, with the bulbous rim then being seated in the groove 32 (see FIGS. 4 and 5).

The lower element 28 is intended to remain mounted on the aerosol can 16 and to be discarded therewith when empty. Accordingly, the lower element is dimensioned, so that the assembly is under tension and resists relative rotational movement of the lower element 28 relative to the aerosol can 16.

The provision of a series of discontinuous protrusions 58 rather than a single continuous flange, however, permits for more ready assembly of the lower element 28 with the aerosol can, by permitting inward flexure of the lower cylindrical portion 60 of the lower element 28. However, a continuous protrusion may be used, if desired. As in the case of the upper element 26, such flexure is resisted when the elements 26 and 28 are assembled together. In addition, the series of discontinuous protrusions 58 enables the lower element 28 to seat securely in the groove 62 defined by the bulbous head 34 of the rim of the aerosol can 16.

Figure 7:
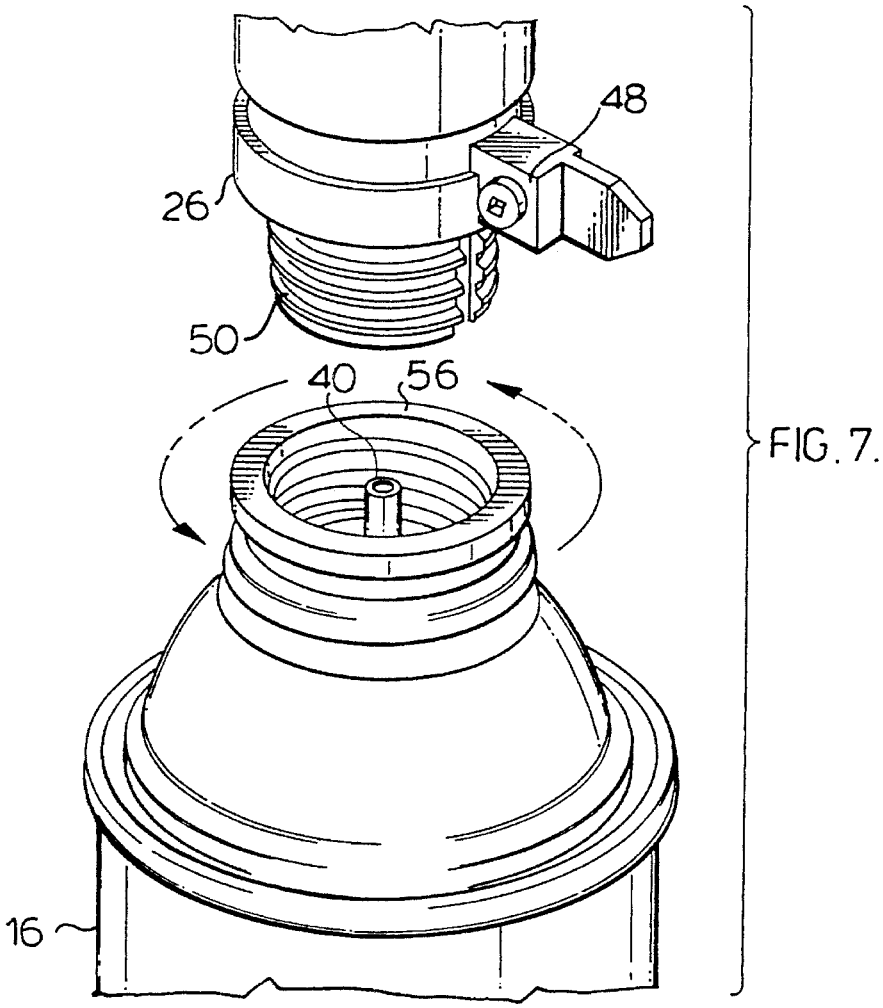
FIGS. 7 and 8 are perspective views showing the manner of assembly of the aerosol can component with the spray-forming component of the device.
Figure 8:
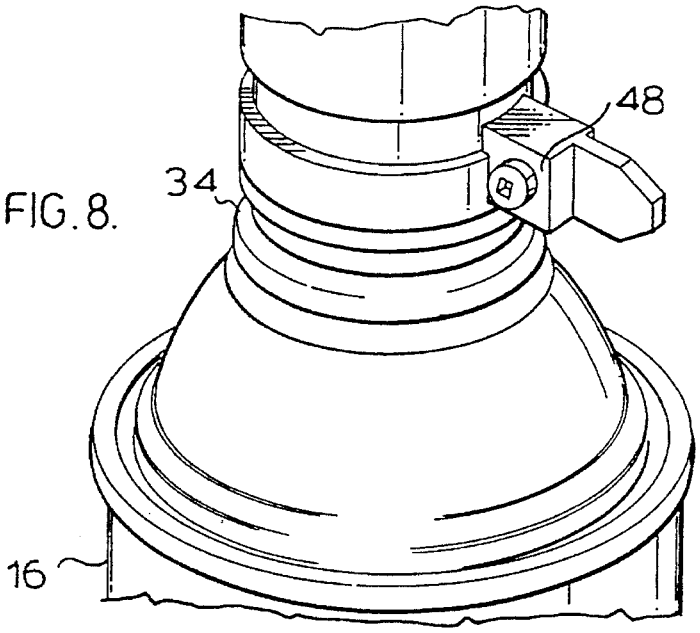

The thread 36 provided on the upper element 26 and the thread 38 provided on the lower element 28 each is continuous and of complimentary chamfered shape, so as to be mating from initial engagement and throughout the screw assembly of the upper and lower elements 26 and 28 together as the aerosol can 16 is mounted to the valve element 18 by rotational movement of the aerosol can 16, as seen particularly in FIGS. 5, 7 and 8.

The elements 26 and 28 are conveniently manufactured by moulding from suitable polymeric material as integral elements. Other manner of manufacture may be employed, however.

SUMMARY OF DISCLOSURE

In summary of this disclosure, the present invention provides a novel device for assembly of an aerosol spray can with a selectively-operable dispensing valve, which permits screw-threaded assembly to be effected in a secure manner and yet permits ready mounting and demounting of the individual screw-threaded elements of the assembly from each other. Modifications are possible within the scope of the invention.

What I claim is:

1. An adaptor device for connecting an aerosol spray can with a selectively-operable valve mechanism for dispensing the contents of said aerosol can, which comprises:

first and second elements, said first element having a right-cylindrical portion having means for mounting said first element to a cylindrical upstream portion of the valve mechanism, said second element having a right cylindrical portion and having means on an external wall of said right cylindrical portion thereof for snap-fit mounting said second element within an undercut rim of the aerosol can and having a right cylindrical portion, each said first and second elements being provided with screw threads which mate with each other to permit said first and second elements to be screw-threadedly assembled and disassembled, said screw threads on said first element being formed on a exterior wall of said right-cylindrical portion thereof, and said screw thread on said second cylindrical portion being formed on a interior wall of said right-cylindrical portion thereof.

2. The device of claim 1 wherein:

said screw threads are in the form of a continuous bevelled thread extending throughout the longitudinal dimension of said right cylindrical portion thereof and in the form of a continuous bevelled thread of complimentary shape to the bevelled screw thread formed on said first element extending throughout the longitudinal dimension of said right-cylindrical portion thereof.

3. An adaptor device for connecting an aerosol spray can with a selectively-operable valve mechanism for dispensing the contents of said aerosol can, which comprises:

first and second elements, said first element having a right cylindrical portion having means for mounting said first element to a cylindrical upstream portion of the valve mechanism, said second element having a right cylindrical portion and having means on an external wall of said right cylindrical portion thereof for snap-fit mounting of said second element within an undercut rim of the aerosol can and having a right cylindrical portion, each said first and second elements being provided with screw threads which mate with each other to permit said first and second elements to be screw-threadedly assembled and disassembled, said screw threads on said first element being formed on an exterior wall of said right-cylindrical portion thereof and said screw threads on said second cylindrical portion being formed on an interior wall of said right-cylindrical portion thereof, said screw threads being in the form of a continuous bevelled thread extending throughout the longitudinal dimension of said right cylindrical portion of said first element and in the form of a continuous bevelled thread of complimentary shape to the bevelled screw thread formed on said first element extending throughout the longitudinal dimension of said right cylindrical-portion of said second element, said first element and said second element each having a radially-directed flange element extending outwardly from an upper extremity of said right-cylindrical portion of each of said first and second elements, whereby said flange elements abut each other when said elements are fully screw-threadedly joined to each other.

4. The device of claim 1 wherein said snap fit means for mounting said second element within an undercut rim of the aerosol can comprises a groove formed on said exterior wall of said right-cylindrical portion thereof to receive in snap-fitting relationship therewith a continuous bulbous head of the rim defining the undercut.

5. The device of claim 4 wherein said means for mounting said first element to a cylindrical upstream portion of the valve mechanism comprises means permanently affixing said first element to or integrally-forming said first element with the cylindrical upstream portion of the valve mechanism.

6. The device of claim 4 wherein said means for mounting said first element to a cylindrical upstream portion of the valve mechanism comprises a continuous protrusion formed on an inner wall of said right-cylindrical portion thereof to be received in snap-fit relationship with a complimentary continuous groove formed in the cylindrical upstream portion of the valve mechanism.

7. An adaptor device for connecting an aerosol spray can with a selectively-operable valve mechanism for dispersing the contents of said aerosol can, which comprises:

first and second elements, said first element having means for mounting same to a cylindrical upstream portion of the valve mechanism and having a right cylindrical portion, said second element having means for mounting same to an undercut rim of the aerosol can and having a right-cylindrical portion, each said first and second elements being provided with screw threads which mate each other to permit screw-threaded joining and unjoining of said first and second elements, said first element and said second element each having a radially-directed flange element extending outwardly from an upper extremity of said right-cylindrical portion of each of said first and second elements, whereby said flange elements abut each other when said elements are fully screw-threadedly joined to each other, said first element including a further cylindrical portion thereof extending from the outer radial extremity of the radially-directed flange thereof in an axial direction opposite to direction of axial extension of the first-mentioned right-cylindrical portion thereof to engage an outer cylindrical wall of said valve mechanism, and said further cylindrical portion having diametrically-opposite slots formed therein to receive therethrough radially-directed mounting elements of the valve mechanism, whereby said first element is locked against rotation relative to the valve mechanism by the extension of the radially-directed mounting elements through the diametrically-opposed slots.

8. The device of claim 7 wherein an upper surface of said radially-directed flange thereof is sloped radially-outwardly in the region of said slots to accommodate a bladed tool between the radially-directed flange and the radially-directed mounting element adjacent thereto to assist in demounting said first element from the valve mechanism when the first element is out of screw-threaded assembly with said second element.

9. An adaptor device for connecting an aerosol spray can with a selectively-operable valve mechanism for dispensing the contents of said aerosol can, which comprises:

first and second elements, said first element having a right cylindrical portion having means for mounting said first element to a cylindrical upstream portion of the valve mechanism, said second element having a right cylindrical portion and having means on an external wall of said right cylindrical portion thereof for snap-fit mounting of said second element within an undercut rim of the aerosol can and having a right cylindrical portion, each said first and second elements being provided with screw threads which mate with each other to permit said first and second elements to be screw-threadedly assembled and disassembled, said screw threads on said first element being formed on an exterior wall of said right-cylindrical portion thereof and said screw threads on said second cylindrical portion being formed on an interior wall of said right-cylindrical portion thereof, said snap fit means for mounting said second element within an undercut rim of the aerosol can comprising a groove formed on said exterior wall of said right-cylindrical portion thereof to receive in snap-fitting relationship therewith a continuous bulbous head of the rim defining the undercut, said means of mounting said first element to a cylindrical upstream portion of the valve mechanism comprising a continuous protrusion formed on an inner wall of said right-cylindrical portion thereof to be received in snap-fit relationship with a complimentary continuous groove formed in the cylindrical upstream portion of the valve mechanism, said right-cylindrical portion of said first element having at least one slot formed therein extending from a closed end at said radially-extending flange thereof to an open end at the lower extremity of said right cylindrical portion thereof, to permit outward resilient flexure of said right-cylindrical portion thereof to assist in mounting said first element to and demounting said first element from the valve mechanism when the first element is out of screw-threaded assembly with said second element.

10. The device of claim 9 wherein two slots are provided in said right-cylindrical portion in diametrically-opposed locations.

11. The device of claim 4 wherein the groove formed on the outer wall of the right-cylindrical portion of said second element is defined by an upper rim adjacent a radially-directed flange extending outwardly from an upper extremity of said right-cylindrical portion of said second element and lower discontinuous elongate protrusions for engaging the undercut.

12. The device of claim 11 wherein each said first and second elements is integrally formed from polymeric material.

13. The device of claim 1 including means locking said first element against rotation relative to the valve mechanism.

14. The device of claim 7 wherein said right-cylindrical portion of said first element has at least one slot formed therein extending from a closed end at said radially-extending flange thereof to an open end at the lower extremity of said right cylindrical portion thereof, to permit outward resilient flexure of said cylindrical portion thereof to assist in mounting said first element to and demounting said first element from the valve mechanism when the first element is out of screw-threaded assembly with said second element.

15. The device of claim 14 wherein two slots are provided in said right-cylindrical portion in diametrically-opposed locations.

* * * * *